US005893413A

United States Patent [19]

Lembcke et al.

[11] Patent Number: 5,893,413

[45] Date of Patent: Apr. 13, 1999

[54] HYDROSTATIC TOOL WITH ELECTRICALLY OPERATED SETTING MECHANISM

[75] Inventors: Jeffrey J. Lembcke; Mark W. Brockman, both of Houston, Tex.

[73] Assignee: Baker Hughes Incorporated, Houston, Tex.

[21] Appl. No.: 08/680,999

[22] Filed: Jul. 16, 1996

[51] Int. Cl.[6] ..... E21B 4/04; E21B 34/08

[52] U.S. Cl. ..... 166/66.6; 166/321

[58] Field of Search ..... 166/66.6, 106, 166/321, 322, 323, 373, 72, 264, 53, 64

[56] References Cited

U.S. PATENT DOCUMENTS

| | | | |
|---|---|---|---|
| 3,674,091 | 7/1972 | Kisling, III . | |
| 4,063,593 | 12/1977 | Jessup | 166/317 |
| 4,216,827 | 8/1980 | Crowe | 166/120 |
| 4,285,400 | 8/1981 | Mullins, II | 166/179 |
| 4,311,195 | 1/1982 | Mullins, II | 166/120 |
| 4,311,197 | 1/1982 | Hushbeck | 166/373 |
| 4,557,333 | 12/1985 | Beck | 166/374 |
| 4,576,233 | 3/1986 | George | 166/297 |
| 4,618,000 | 10/1986 | Burris, II | 166/373 |
| 4,796,699 | 1/1989 | Upchurch . | |
| 4,796,708 | 1/1989 | Lembcke . | |
| 4,798,247 | 1/1989 | Deaton et al. . | |
| 4,856,595 | 8/1989 | Upchurch | 166/374 |
| 4,886,126 | 12/1989 | Yates, Jr. . | |
| 4,903,775 | 2/1990 | Manke | 166/373 |
| 5,050,681 | 9/1991 | Skinner . | |
| 5,146,983 | 9/1992 | Hromas et al. . | |
| 5,203,414 | 4/1993 | Hromas et al. . | |
| 5,207,272 | 5/1993 | Pringle et al. . | |
| 5,226,491 | 7/1993 | Pringle et al. . | |
| 5,226,494 | 7/1993 | Rubbo et al. . | |
| 5,230,383 | 7/1993 | Pringle et al. . | |
| 5,236,047 | 8/1993 | Pringle et al. . | |
| 5,240,077 | 8/1993 | Whitsitt . | |
| 5,251,703 | 10/1993 | Skinner . | |
| 5,257,663 | 11/1993 | Pringle et al. . | |
| 5,343,963 | 9/1994 | Bouldin et al. . | |
| 5,369,579 | 11/1994 | Anderson . | |

FOREIGN PATENT DOCUMENTS 2 294 486 5/1996 United Kingdom .

*Primary Examiner*—Frank Tsay
*Attorney, Agent, or Firm*—Madan & Morris, PLLC

[57] ABSTRACT

The present invention provides a tool for use in wellbores. The tool is operated by the wellbore hydrostatic pressure. The tool includes one or more devices that operate when a mechanical force is applied to such devices. The tool includes at least one atmospheric chamber. A setting member disposed in the tool is utilized to provide the mechanical force in response to the application of the hydrostatic pressure thereto. Prior to activating the tool, the setting member is locked or restrained in an inoperative position. To operate the device, the tool is placed at a suitable location in the wellbore. The atmospheric chamber is charged with the wellbore fluid, which releases the setting member from its restrained or locked position, subjecting the setting member to the wellbore hydrostatic pressure, thereby providing the mechanical force to operate at least one of the devices. A second atmospheric chamber may be provided that remains at the atmospheric pressure, but cooperates with the first chamber as it is charged with the wellbore fluid to operate a second setting member, which operates a second device. A sensor associated with the tool detects signals transmitted to the tool from a remote location. A control circuit in the tool receives the detected signals from the sensor and in response thereto operates an electrically-operated flow control device, thereby charging the chamber with the wellbore fluid.

28 Claims, 4 Drawing Sheets

HYDROSTATIC TOOL WITH ELECTRICALLY OPERATED SETTING MECHANISM

BACKGROUND OF THE INVENTION

1. Field of the Invention

This invention relates generally to downhole tools for use in oil or gas wells and, more particularly, to wellbore annulus pressure-responsive tools which are actuated by an electrically controlled device.

2. Background of the Art

A variety of downhole devices (tools) are utilized in wellbores to facilitate production of hydrocarbons from subterranean formations. For example, packers are commonly utilized to seal an annulus between the packer and a tubular member (typically a wellbore casing) placed within the wellbore. Producing wellbores usually contain formation fluids, such as hydrocarbons (oil and or gas) and/or connate water. During drilling operations, wellbores typically contain drilling fluids (commonly known as the "drilling mud" or "mud") pumped into the wellbore from a surface location. The pressure at a given depth in the wellbore depends upon the weight of the fluid column above the depth point. Such a pressure is referred to as the hydrostatic pressure or simply the hydrostatic, and it may vary between a few hundred psi to several thousand psi.

A variety of downhole tools utilize the hydrostatic pressure to perform a useful function. The majority of such tools utilize either a mechanical force or an explosive charge to actuate a device, which in turn enables the hydrostatic pressure to act upon a secondary devices to perform an operation downhole. More recently, electrically operated devices have been utilized in commercial tools to selectively allow the application of the hydrostatic pressure to perform a specific function.

For example, U.S. Pat. No. 5,251,703 to Skinner discloses a system wherein a solenoid valve in a normally closed position is placed between the well annulus and a chamber. The chamber has two sections separated by a power piston. One section communicates with the wellbore via the solenoid valve and the other section is filled with a working liquid and compressed nitrogen to provide back pressure to the first section. When the solenoid valve is opened, hydrostatic pressure is applied to the first section, causing the piston to move, which operated a device coupled thereto. U.S. Pat. No. 5,251,703 to Skinner discloses three chambers and a plurality of electrically-operated valves for manipulating the application of the hydrostatic pressure to a piston in one of the chambers to cause a device to operate.

U.S. Pat. No. 5,240,077 to Whitsitt discloses a hydraulic setting tool, which is actuated by an electric motor driving a pump. The Whitsitt device uses a closed hydraulic system to maintain a minimum head pressure of hydraulic fluid at the pump intake to reduce or eliminate cavitation, thus improving the tool viability in high temperature wells.

The present invention provides a relatively simple and reliable downhole tool wherein the hydrostatic pressure is applied to at least one atmospheric chamber in the tool by activating a remotely controlled electrically-operated device. A control circuit in the tool activates the device in response to a coded signal transmitted from a remote location, such as the surface.

SUMMARY OF THE INVENTION

The present invention provides a tool for use in wellbores. The tool is operated by the wellbore hydrostatic pressure.

The tool includes one or more devices that operate when a mechanical force is applied to such devices. The tool includes at least one atmospheric chamber. A setting member disposed in the tool is utilized to provide the mechanical force in response to the application of the hydrostatic pressure thereto. Prior to activating the tool, the setting member is locked or restrained in an inoperative position. To operate the device, the tool is placed at a suitable location in the wellbore. The atmospheric chamber is charged with the wellbore fluid, which releases the setting member from its restrained or locked position, subjecting the setting member to the wellbore hydrostatic pressure, thereby providing the mechanical force to operate at least one of the devices. A second atmospheric chamber may be provided that remains at the atmospheric pressure, but cooperates with the first chamber as it is charged with the wellbore fluid to operate a second setting member, which operates a second device. A sensor associated with the tool detects signals transmitted to the tool from a remote location. A control circuit in the tool receives the detected signals from the sensor and in response thereto operates an electrically-operated flow control device, thereby charging the chamber with the wellbore fluid.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, and wherein.

DETAILED DESCRIPTION OF PREFERRED EMBODIMENTS

Figure 1A:
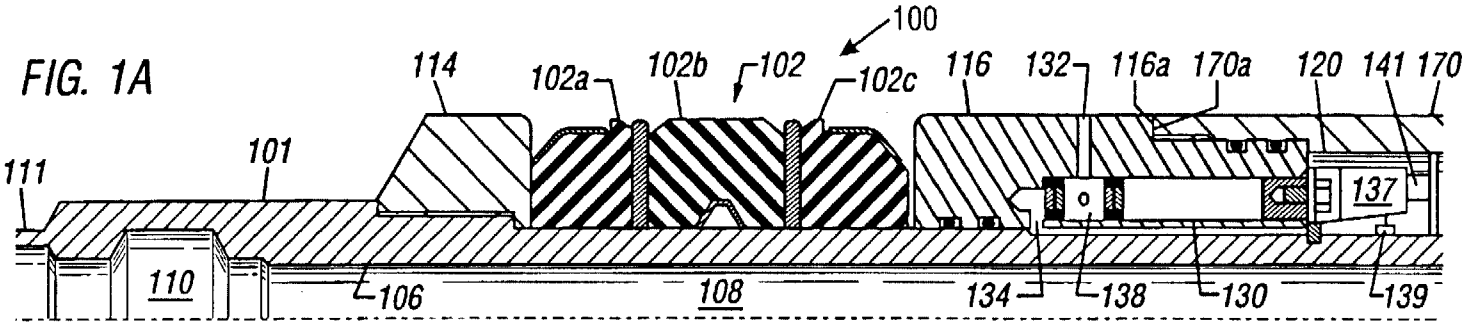
FIGS. 1A–1C show a longitudinal partial cross-sectional view of a downhole tool according to the present invention, in its normal closed position.
Figure 1B:
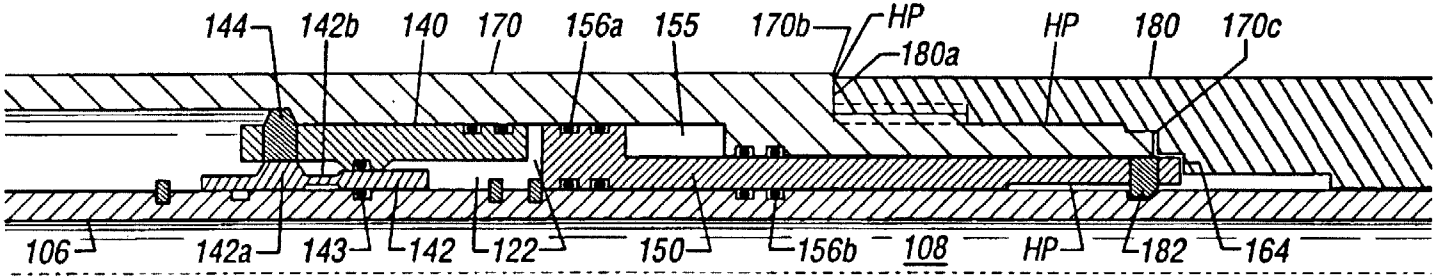
Figure 1C:
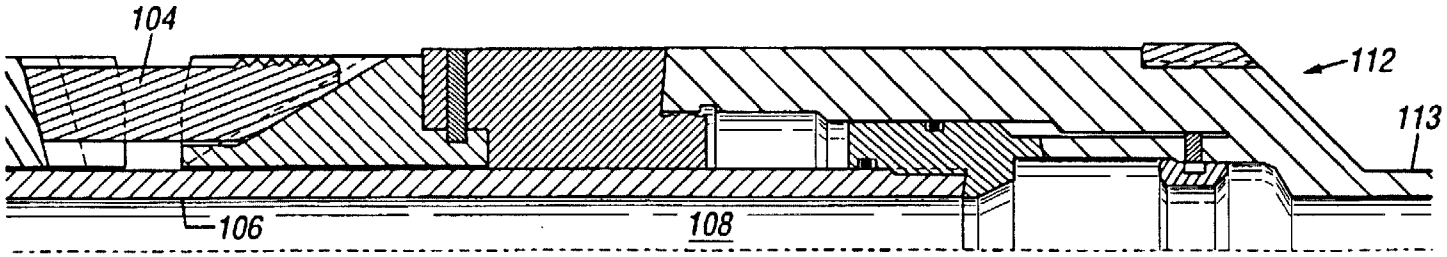
Figure 2A:
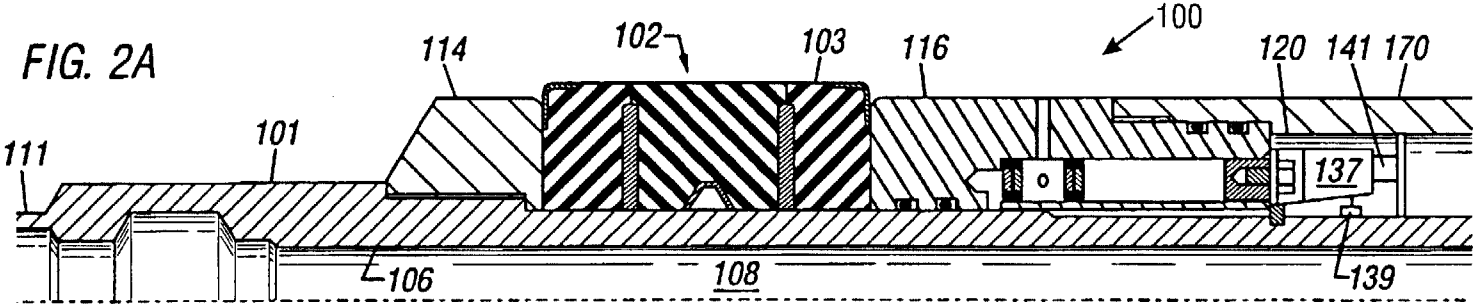
FIGS. 2A–2C show a longitudinal partial cross-sectional view of the downhole tool shown in FIGS. 1A–1C after the tool has been set by applying the hydrostatic pressure upon the activation of the electrically-operated device.
Figure 2B:
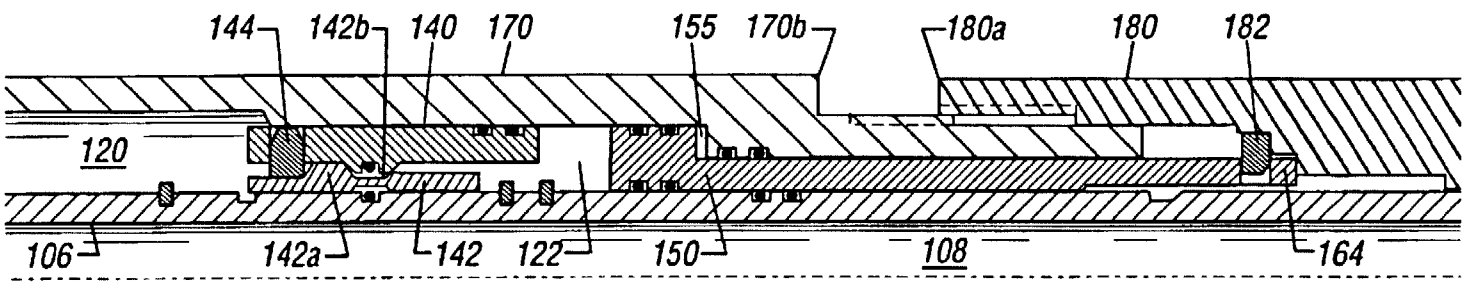
Figure 2C:
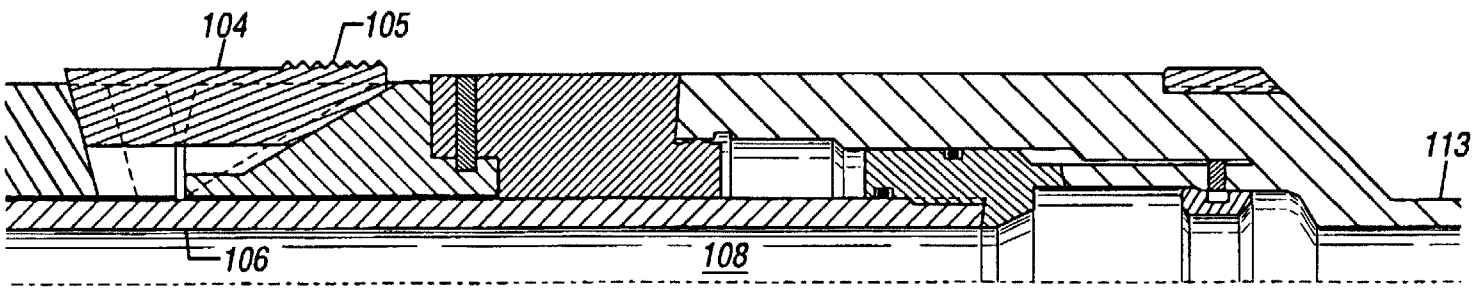
Figure 3A:
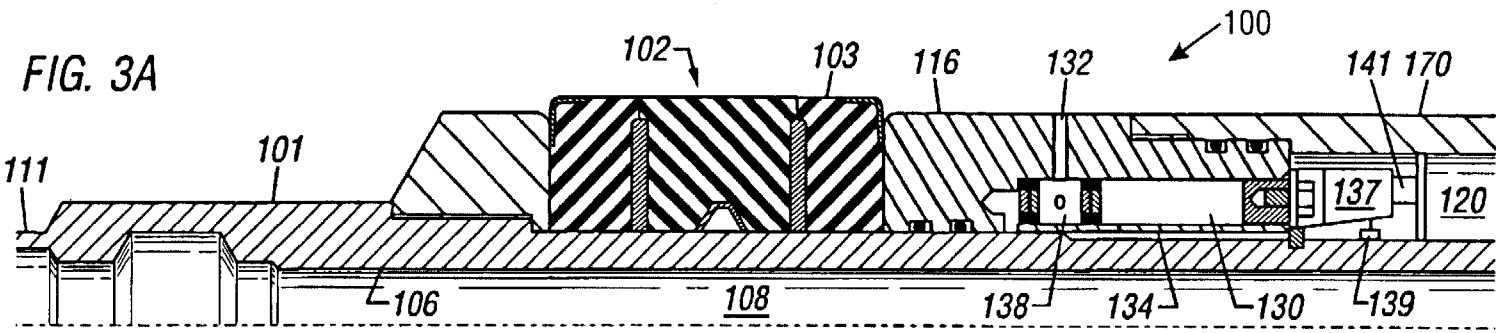
FIGS. 3A–3C show a longitudinal partial cross-sectional view of the downhole tool shown in FIGS. 1A–1C after the tool has been set by applying the hydrostatic pressure upon the activation of a secondary mechanical means.
Figure 3B:
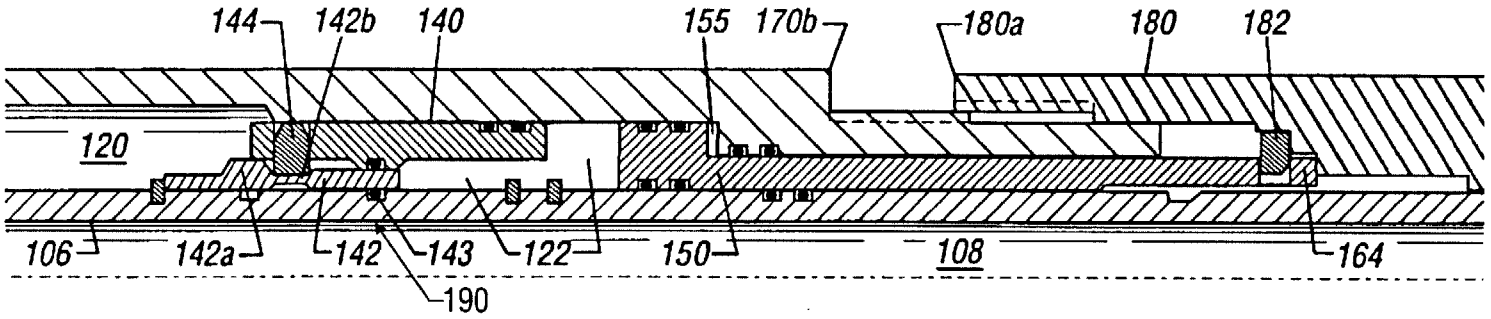
Figure 3C:
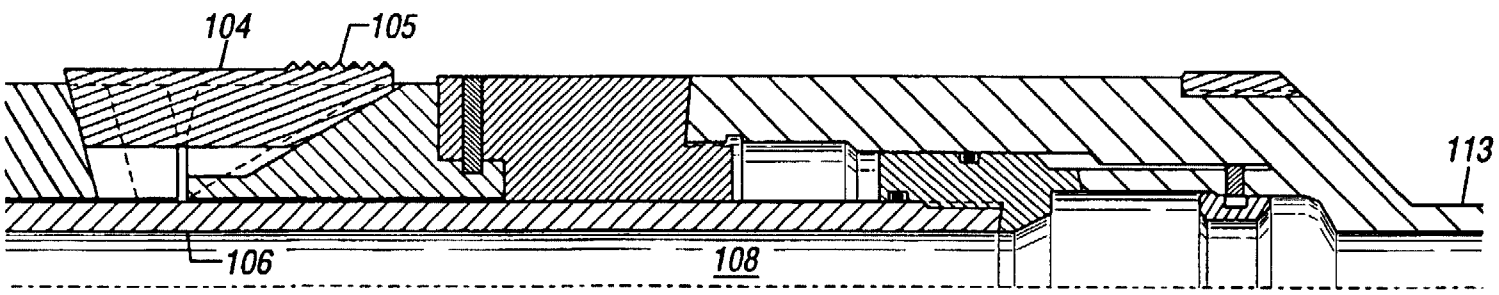

FIGS. 1A–1C show a partial cross-sectional view of an embodiment of a downhole hydrostatic tool 100 in its normally closed position, i.e., prior to setting of the tool in a wellbore according to the present invention. FIGS. 2A–2C show a partial cross-sectional view of the tool shown in FIGS. 1A–1C after it has been set by activating an electrically-operated device. FIGS. 3A–3C show a partial cross-sectional view of the tool shown in FIGS. 1A–1C after it has been set by activating a secondary mechanical means. In these figures, the tool 100 is shown to contain a packing element system 102 having a plurality of individual packing elements 102*a–c* and an anchor or slip 104 as examples of the type of devices that may be set in a wellbore by the wellbore hydrostatic pressure according to the present invention. The application of the present invention, however, is not limited to such devices. Any other suitable device may be set by utilizing the concept of the present invention.

Referring to FIGS. 1A–1C and FIGS. 2A–2C, the tool 100 is substantially tubular having an interior surface 106 defining an internal axial bore through the tool or a through passage 108 for allowing the passage of fluids or other devices through the tool 100. The tool 100 has a suitable profile 110 at an upper end 111 that enables the tool to attach or couple to another device or an element, such as a tubing. The tool 100 terminates with a lower profile 112 at a lower end 113, for attachment to a desired element. The packing element system 102 is disposed between a fixed member 114 and a movable setting subassembly (also referred herein as the setting sub or setting member) 116. The packing element system 102 contains one or more individual packing members, such as members 102*a–c*. The packing members expand radially outward when the setting sub 116 is urged against the packing element system 102, which causes the packing elements 102*a–c* to seal against the interior of a wellbore, typically a casing (not shown).

The tool 100 is shown to contain three atmospheric chambers. The first atmospheric chamber 120 is defined in the tool body 101 adjacent to the setting sub 116 along the downhole or lower side of the tool between the tool interior 106 and a slidable outer housing 170, the functions and operation of which housing are described later. The first atmospheric chamber 120 may be selectively placed in fluid communication with the fluid surrounding the tool (the wellbore fluid when the tool 100 is placed in the wellbore) by an electrically-operated device 130. The device 130 is preferably disposed within the setting sub 116 to control the flow of the wellbore fluid to the first chamber 120 from a fluid inlet or port 132 to a fluid passage 134. The device 130 acts as a fluid control valve. In a preferred embodiment, the device 130 contains a piston 138 that is held in a closed position that prevents the flow of any fluid from the port 132 to the passage 134, and hence the first atmospheric chamber 120. The device 130 is preferably a solenoid-type device, which moves the piston 138 to the right or the open position when electrical energy is applied to the device 130, allowing the wellbore fluid to flood the first atmospheric chamber 120. The fluid control device 130 remains closed at all other times. Alternatively, the fluid control device 130 may be operated by a motor (not shown) or by any other suitable electrically-operated device.

An electronic control circuit 137, preferably placed in the first atmospheric chamber 120, controls the operation of the device 130. A sensor 139 associated with the tool 100 detects signals transmitted from a remote location, such as the surface, and transmits the detected signals to the control circuit 137. In one embodiment, the sensor may be a strain gauge securely attached to the body 101 and the signals transmitted from the surface may be in the form of pulses induced into the wellbore fluid at a desired frequency. The sensor 139 communicates the detected signals to the electronic control circuit 137. The tool 100 is preferable assigned an address, which is stored in a downhole memory associated with the tool 100. The electronic control circuit 137 decodes the signals received from the sensor 139 and, if the signals match the unique tool address, it causes the electrical energy from a power pack 141 to be applied to an electrically-operated device 130, such as a solenoid or a motor 130. When the device 120 is activated by the device 130, the piston 138 moves to the right, opening fluid communication between the wellbore fluid and the first atmospheric chamber 120, as described in more detail later.

A second atmospheric chamber 122 is formed between a retaining sleeve 140 and the tool interior 106. A movable locking sleeve 142 is disposed between the first and second atmospheric chambers to prevent any fluid communication between these chambers. A seal 143 formed in the member 140 and the body 101 provides the fluid seal between the two chambers. The locking sleeve has a seat 142*a* which holds a locking member 144 in place. In this position, the locking member 144 restrains the outer housing from moving due to the presence of the hydrostatic pressure being applied to the outer housing. The locking member 142 has a reduced dimension 142*b* between the seat 142*a* and the seal 143. If the locking member 142 is moved to the right (downward), the seat moves from under the locking member 144, releasing the locking member and, thus, the outer housing from its initial restrained position and the reduced dimension 142*b* moves inside the seal 143, thereby allowing the fluid to pass from the first chamber 120 to the second chamber 122. If the locking member 142 is moved a sufficient distance to the left (upward), the locking sleeve moves out of the seal 143, thereby allowing the fluid to pass from the first chamber 120 to the second chamber 122. Thus, these two chambers and the locking sleeve 142 cooperate to prevent any fluid communication between the first atmospheric chamber 120 and the second atmospheric chamber 122, as long as the flow control device 130 remains in the closed position, as shown in FIG. 1A. A setting piston 150 is disposed between the atmospheric chamber 122 and a third atmospheric chamber 155, which always remains at a relatively low pressure during operation of the tool 100.

A slip ring 180 is disposed around the tool 100 between the housing 170 and the anchor 104 setting the anchor when the slip ring 180 is subjected to the wellbore hydrostatic pressure. The outer housing 170 is specially profiled around the setting sub 116, the retaining sleeve 140, the various atmospheric chambers and the slip ring 180. An upper end 170*a* of the outer housing 170 abuts an edge 116*a* formed by a reduced outer dimension of the setting sub 116. An end 170*b*, formed by a reduced dimension of the housing 170, abuts against an upper end 180*a* of the slip ring 180. The lower end 170*c* of the outer housing 170 retains a retainer member or dog 182 between the slip 180 and the setting piston 150.

The operation of the tool 100 will now be described, while referring to FIGS. 1A–1C and FIGS. 2A–2C. To set the tool 100 in a wellbore, it is conveyed into a wellbore and positioned at the desired place. The tool 100 may be conveyed by any suitable method, such as by a tubing or a wireline. The tool 100 in the wellbore is surrounded by the wellbore fluid, which is at a relatively high pressure (referred herein as the "hydrostatic pressure"). When the tool 100 is in the wellbore, the areas of the tool 100 denoted by HP in FIGS. 1A–1C are at the hydrostatic pressure, as such areas are in fluid communication with the wellbore fluid. Each of the atmospheric chambers 120, 122 and 155, however, remains at their respective initial pressures (atmospheric pressure), except for minor changes due to change in the temperature from the surface to the wellbore depth, where the tool is placed.

The tool 100 at this stage is inoperative. In this inoperative mode, the locking sleeve 142 remains stationary as the pressure in both the first chamber 120 and the second chamber 122 is the same. The seal 143 prevents any movement of the locking sleeve 142 into the second chamber 122. The locking member 144 is held in place by the locking sleeve 142, which prevents the outer housing 170 from moving toward the setting sub 116, even though the outer housing is under the hydrostatic pressure. The slip ring 180 prevents the outer housing 170 from moving it to the right, i.e., toward the slip 104. The slip ring 180 remains stationary, as the retaining member 182 prevents any movement of the slip ring 180 to the right. The setting piston 150 remains in its initial position between the second chamber 122 and the third chamber 155 as the retaining member 182 remains locked in its position between the outer housing 170 and the pin 164. Seals 156*a* and 156*b* around the setting piston 150 provide hydraulic seals that prevent flow of any fluid into the third chamber 155, which as noted earlier, remains at the low pressure. Thus, in the nonoperative mode, the devices, such as the packing element system 102 and the anchor 104, remain in their respective retracted positions, as shown in FIGS. 1A–1C.

After the tool 100 has been positioned at the desired location within the wellbore, it is ready to be set in the wellbore. Once the control circuit 139 receives the command or actuation signal from the surface, it causes power from the downhole power pack 141 to be sent to the device 135, which actuates the flow control device 130, causing the wellbore fluid to flood the first chamber 120. The flooding of the first chamber 120 causes the pressure in the first chamber 120 to suddenly rise to the hydrostatic pressure, creating a differential pressure between the first chamber 120 and the second chamber 122, which is still at the initial low pressure. This pressure differential acts across the o-rings 143 around the locking sleeve 142, shifting the locking sleeve 142 to the right (downhole). Shifting of the locking sleeve 142 releases the locking member 144, releasing the outer housing from the initial locked position and allowing the fluid from the first chamber 120 to flood the second chamber 122.

Releasing the locking member 144 frees the outer housing 170 from its initial locked position. The hydrostatic pressure acting on the outer sleeve 170 moves it to the left (upward), causing the upper end 170*a* to urge against the reduced end 116*a* of the setting sub 116, which in turn urges the setting element system 102, causing the setting elements 102*a–c* to expand radially outward as shown by numeral 103, setting the element system in the wellbore. Once the outer housing 170 has moved a sufficient distance upward, it uncovers the retaining element (retainer dog) 164, leaving the setting piston 150 free to move downward. The hydrostatic pressure in the second chamber 122 acts on the setting piston 150, causing it to move to the right (downward), closing the third chamber 155 from below. The third chamber, however remains at a relatively low pressure, since it remains isolated from the hydrostatic pressure. As the setting piston 155 moves to the right (downward), it urges the slip ring 180 toward the anchor 104, causing the anchor to expand radially outward, thereby setting the anchor teeth 105 in the wellbore casing.

Thus, in the embodiment of the invention shown in FIGS. 1A–1C and described above, all of the chambers (chambers 120, 122 and 155) are initially at a relatively low pressure (typically atmospheric pressure). The chambers cooperate with each other to release the setting members from their initial restrained or locked positions, allowing the hydrostatic pressure to move these setting members to their respective second positions. Each of the setting members provides the desired mechanical force to its associated device in the second position, thereby operating its associated devices.

The above-described electrically-operated setting mechanism is the primary or preferred setting mechanism. The present invention provides a secondary mechanical method for operating the devices 102 and 104 if the primary mechanism fails to operate after the tool has been set in position in the wellbore. The operation of the secondary mechanism will now be described while referring to FIGS. 3A–3C. A punch hole 190 is formed in the body 101 that may be punched from within the interior 108 of the tool 100. The punch hole 190 is positioned such that when the hole is punched, it will enable the wellbore fluid from the interior 108 to flood the second atmospheric chamber 122. The flooding of the second chamber will causes the hydrostatic pressure to act on the o-rings 143 of the locking sleeve 142, shifting the locking sleeve 142 to the left (upward), unlocking the locking member 144. The remaining operation of the various elements for setting the elements 102 and 104 is the same as described above in reference to FIGS. 1A–1C and FIGS. 2A–2C.

Figure 4:
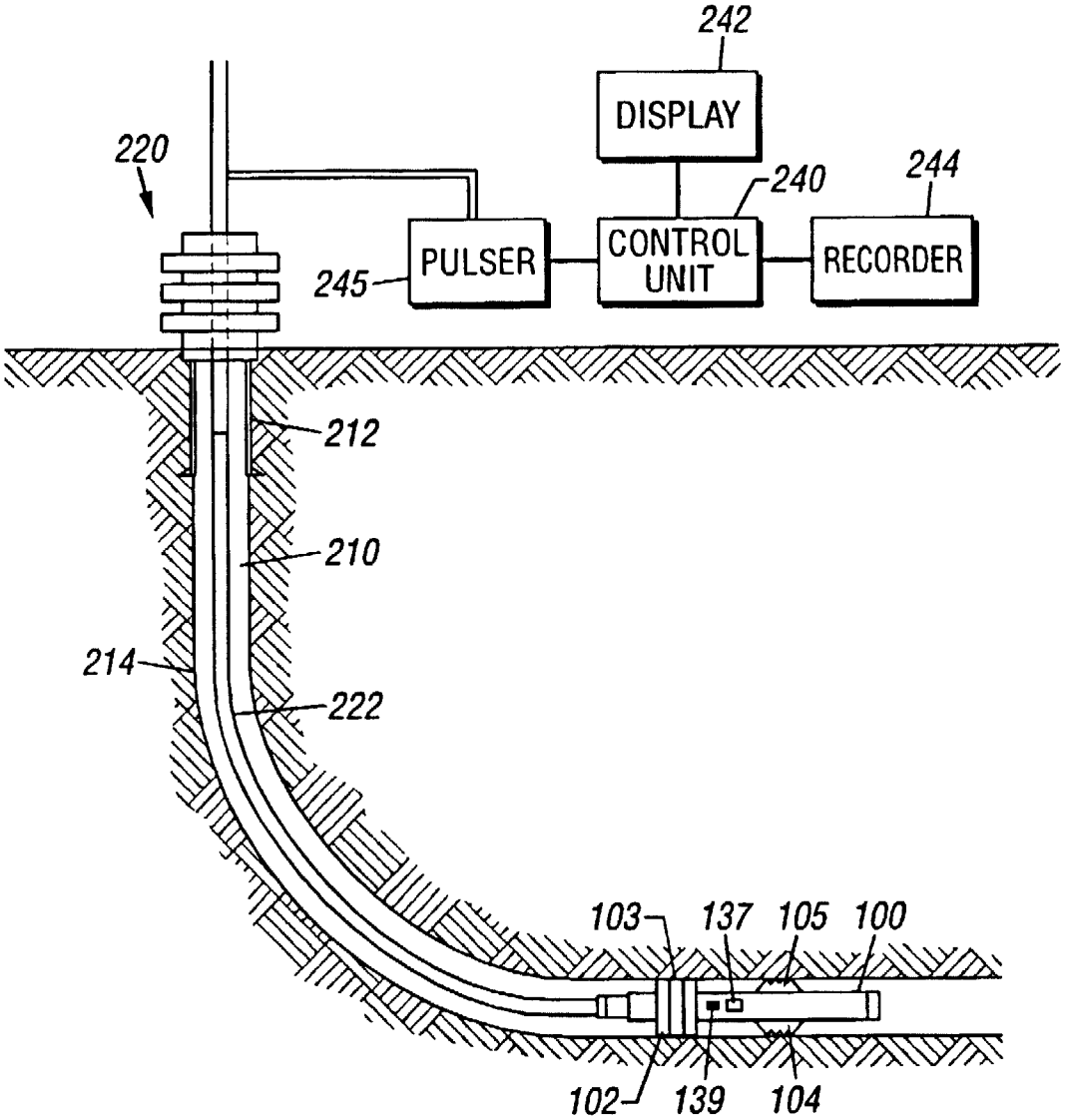
FIG. 4 shows a schematic diagram of a cased wellbore with the tool of FIG. 1A–1C set in the wellbore and associated control units for communicating command signals to the tool after it has been conveyed to the location where the tool will be set.

FIG. 4 shows a schematic elevational diagram of a system for setting the tool 100 in the wellbore 210. The wellbore 210 is shown lined with a casing 214. The tool 100 is conveyed into the wellbore 210 through a wellhead equipment 220 by a suitable means, such as a tubing 222. A control unit 240 at the surface causes a pulser 245 to induce pressure pulses at a predetermined frequency corresponding to the address stored in the tool 100. The pulses are transmitted downhole via the wellbore fluid 250. As described earlier, the sensor 139 detects the pulses, and transmits corresponding signals to the control circuit 137 in the tool 100. The control circuit 137 then causes the device 130 (see FIG. 1A) to operate as described earlier, thereby operating the devices 102 and 104. It should be noted that any suitable apparatus and method may be used to activate the tool.

The present invention contemplates the use of one or more of the apparatuses and methods for generating and receiving the signals described in U.S. Pat. Nos. 5,226,494 and 5,343,963, which are incorporated herein by reference. The present invention, however, may utilize any other suitable means for communicating command signals to the control circuit 137 in the tool 100. For example, the command signals may be transmitted from a remote location by a magnetic device, direct transmission of signals over a data link or any other suitable means. Appropriate sensors corresponding to these devices will then be placed in the tool to detect the transmitted signals. In majority of the applications for the device of the present invention, a one way communication from the surface to the downhole control circuit 137 is sufficient. The system 200 shown FIG. 4 may utilize a two-way telemetry. In that case, the downhole control circuit is designed to contain electronic circuitry that is adapted for two-way communication.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A tool for use in a wellbore having a wellbore fluid at a hydrostatic pressure; comprising;

(a) a device operable by the application of a mechanical force thereto;

(b) a setting member in communication with the wellbore fluid for applying the mechanical force to the device, the setting member being releasably restrained from applying the mechanical force to the device;

(c) a low pressure chamber in the tool for releasing the setting member when the low pressure chamber is charged with the wellbore fluid; and (d) a flow control device for selectively charging the low pressure chamber with the wellbore fluid to release the setting member from its restrained position to allow the setting member to apply the mechanical force to the device.

2. The tool of claim 1, wherein the device is selected from a group consisting of (a) a packer, and (b) an anchor.

3. The tool of claim 1, wherein the flow control device is an electrically-operated device.

4. The device of claim 1, further comprising:

(i) a sensor associated with the tool, the sensor detecting signals transmitted from a remote location to the sensor; and (ii) a control circuit in the tool for receiving the detected signals from the sensor and in response thereto operating the flow control device.

5. The tool of claim 4, wherein the sensor is a strain gauge coupled to the tool.

6. The tool of claim 5, wherein the signals are transmitted by inducing pressure pulses into wellbore fluid.

7. The tool of claim 6, wherein the flow control device is one of a solenoid valve and a valve operated by a motor.

8. An oil field tool for use in a wellbore having a fluid therein at relatively high hydrostatic pressure, comprising:

(a) at least two setting devices, each such setting device operable upon the application of a mechanical force thereto;

(b) at least two setting members, each setting member adapted to operate an associated one of the at least two setting devices upon the application of the high hydrostatic pressure to such setting member, each such setting member releasably restrained prior to the application of the high pressure thereto for setting its associated setting member; and (c) at least two chambers in the tool, each such chamber at a relatively low pressure, one of the at least two chambers adapted to be charged with the wellbore fluid at the relatively high hydrostatic pressure after the tool has been conveyed in the wellbore, said at least two chambers cooperating with each other when one of the chambers is charged with the wellbore fluid to release the at least two setting members from their respective restrained positions, subjecting the at least two setting members to the relatively high hydrostatic pressure, thereby causing each of the at least two setting members to operate its associated setting device; and (d) a flow control device between the wellbore fluid and the chamber adapted to be charged with the wellbore fluid for controlling the wellbore fluid flow into such chamber.

9. The tool of claim 8, wherein one of the at least two setting devices is a packer.

10. The tool of claim 9, wherein one of the at least two setting devices is an anchor for anchoring the tool in the wellbore.

11. The tool of claim 8, wherein one of the at least two chambers remains at the relatively low pressure.

12. The tool of claim 8, wherein each of the setting members is adapted to move from a first inoperative restrained position to a second position when such member is subjected to the relatively high hydrostatic pressure.

13. The tool of claim 12, wherein each of the setting members in its respective second position urges its associated setting device to set such setting device in the wellbore.

14. The tool of claim 8, wherein the flow control device is an electrically-operated device.

15. The tool of claim 14, wherein the flow control device is a solenoid valve.

16. The device of claim 8, further comprising:

(i) a sensor associated with the tool, the sensor detecting signals transmitted from a remote location to the sensor; and (ii) a control circuit in the tool for receiving the detected signals from the sensor and in response thereto operating the flow control device.

17. The tool of claim 16, wherein the sensor is a strain gauge.

18. The tool of claim 16, wherein the command signals are transmitted by inducing pressure pulses into wellbore fluid.

19. A tool for use in a wellbore having a fluid therein at relatively high hydrostatic pressure, comprising:

(a) an elongated tool body having a bore therethrough;

(b) a first device and a second device, each such device adapted to be operated upon the application of a mechanical force to perform a function in the wellbore;

(c) a first setting member movable from a first position to a second position by the hydrostatic pressure, said first setting member adapted to generate the mechanical force to operate the first device in the wellbore when the first setting member is moved to the second position, said first setting member being restrained in the first position prior to conveying the tool in the wellbore;

(d) a second setting member movable from a first position to a second position by the hydrostatic pressure, said second setting member adapted to generate the mechanical force to operate the second device in the wellbore when the second setting member is moved to the second position, said second setting member being restrained in the first position prior to conveying the tool in the wellbore;

(e) a first chamber and a second chamber, each such chamber at an initial relatively low pressure, the first chamber adapted to receive the wellbore fluid and the second chamber adapted to remain at the relatively low pressure, said first and second chambers cooperating with each other upon the receipt of the wellbore fluid into the first chamber to release the first setting member and the second setting member from their respective first positions, thereby enabling the relatively high hydrostatic pressure to move the first and second setting members to their respective second positions, thereby generating sufficient mechanical force to set their associated devices;

(f) a fluid communication path between the wellbore fluid and the first chamber;

(g) a flow control device in the fluid communication path for selectively enabling the communication of the wellbore fluid into the chamber;

(h) a sensor associated with the tool for detecting command signals transmitted to the tool; and (i) a control circuit in the tool for selectively operating the flow control device in response to the signals detected by the sensor.

20. The tool of claim 19 further comprising a third chamber at an initial relatively low pressure, the third chamber placed between the first and the second chamber for receiving the relatively high pressure wellbore fluid from the first chamber and in response thereto causing the second chamber to release the second setting member from its initial restrained position.

21. The tool of claim 20, wherein a movable member placed between the first and the third chambers releases the first movable member when the first chamber receives the high pressure wellbore fluid.

22. The tool of claim 20, wherein the control circuit is placed in the first chamber.

23. A downhole tool for use in a wellbore containing wellbore fluid at a hydrostatic pressure, said downhole tool comprising:

(a) a device adapted to operate upon the application of a mechanical force;

(b) a movable member in communication with the wellbore fluid pressure for applying the mechanical force to the device, said movable member being held in a restrained position that prevents the application of the mechanical force to the device;

(c) a low pressure chamber adapted to be in fluid communication with the wellbore fluid, said chamber having an associated restraining member preventing the movable member from applying the mechanical force to the device until the wellbore fluid is supplied to the low pressure chamber; and (d) an electrically-operated device, said electrically-operated device in one operating position allowing the wellbore fluid at the hydrostatic pressure to be supplied to low pressure chamber to cause the restraining member to release the movable member from the restrained position, thereby allowing the movable member to apply the mechanical force to the device.

24. A downhole tool for use in a wellbore containing a wellbore fluid at a hydrostatic pressure, said downhole tool comprising;

(a) a device operable in the wellbore upon the application of a mechanical force thereto;

(b) a movable member in communication with the wellbore fluid at the hydrostatic pressure for applying the mechanical force to the device;

(c) a restraining assembly in the tool restraining the movable member from applying the mechanical force to the device until the restraining assembly is acted upon by the wellbore fluid; and (d) an electrically-operated device, said electrically-operated device in a normal operating position preventing the wellbore fluid from acting on the restraining assembly and upon activation allowing the wellbore fluid to act on the restraining assembly, allowing the movable member to release from the restrained position and apply the mechanical force to the device.

25. The downhole tool of claim 24, wherein the device is selected from a group consisting of a packer, an anchor, and a sliding sleeve.

26. The downhole tool of claim 24, wherein the restraining assembly includes a first chamber near the atmospheric pressure and a pin as a restraining element.

27. The downhole tool of claim 26, wherein the electrically-operated device is disposed between the first chamber and the wellbore fluid and the actuation of the electrically-operated device allows the wellbore fluid at the hydrostatic pressure to enter the first chamber, causing the pin to release the movable member from its restrained position.

28. The downhole tool of claim 24, wherein the electrically-operated device is selected from a group consisting of (a) a solenoid fluid control valve and (b) an electric motor-operated fluid control valve.

* * * * *